US008814971B2

(12) United States Patent
Johnston

(10) Patent No.: US 8,814,971 B2
(45) Date of Patent: Aug. 26, 2014

(54) AIR-CONDITIONING DUCT FILTERING SYSTEM

(71) Applicant: Thomas W. Johnston, Scottsdale, AZ (US)

(72) Inventor: Thomas W. Johnston, Scottsdale, AZ (US)

(73) Assignee: Johnston Engineering Company, Scottsdale, AZ (US)

( * ) Notice: Subject to any disclaimer, the term of this patent is extended or adjusted under 35 U.S.C. 154(b) by 0 days.

(21) Appl. No.: 13/654,089

(22) Filed: Oct. 17, 2012

(65) Prior Publication Data

US 2014/0102056 A1 Apr. 17, 2014

(51) Int. Cl.
*B01D 45/00* (2006.01)

(52) U.S. Cl.
USPC ..... 55/481; 55/419; 55/478; 55/480; 55/484

(58) Field of Classification Search
CPC ..... F02B 25/22
USPC ..... 55/480–481, 490–493, 495, 508, 511, 55/DIG. 31, DIG. 35, DIG. 37, 468, 419, 55/484, 195, 497, 510; 96/60, 223
See application file for complete search history.

(56) References Cited

U.S. PATENT DOCUMENTS

| | | | | |
|---|---|---|---|---|
| 3,513,634 | A | 5/1970 | Angonese et al. | |
| 3,626,668 | A | 12/1971 | Cardiff | |
| 4,713,099 | A | 12/1987 | Schroeder | |
| 4,743,281 | A | 5/1988 | Kennedy et al. | |
| 5,245,527 | A | 9/1993 | Duff et al. | |
| 5,254,033 | A | 10/1993 | Brauen et al. | |
| 5,679,121 | A | 10/1997 | Kim | |
| 5,863,310 | A * | 1/1999 | Brown et al. | 55/480 |
| 5,944,860 | A | 8/1999 | Mack et al. | |
| 6,030,427 | A | 2/2000 | Sorice et al. | |
| 6,354,936 | B1 | 3/2002 | Noh et al. | |
| 6,387,164 | B1 | 5/2002 | Cheng | |
| 6,425,945 | B1 | 7/2002 | Cheng | |
| 6,526,773 | B1 * | 3/2003 | Cho | 62/262 |
| 7,650,709 | B2 | 1/2010 | Kim et al. | |
| 8,215,123 | B2 | 7/2012 | Agarwal | |

* cited by examiner

*Primary Examiner* — Jason M Greene
*Assistant Examiner* — Karla Hawkins
(74) *Attorney, Agent, or Firm* — Weiss & Moy, P.C.; Jeffrey D. Moy

(57) ABSTRACT

An air conditioning system duct housing has a plurality of walls coupled together, having at least one outside air intake, at least one return air intake and an air supply outlet channel; a filter; and a receiving aperture (mixed air plenum) to receive the filter therein, wherein the receiving aperture (mixed air plenum) is interposed between the at least one outside air intake, the at least one return air intake and the air supply outlet channel.

19 Claims, 5 Drawing Sheets

AIR-CONDITIONING DUCT FILTERING SYSTEM

BACKGROUND

Embodiments of this disclosure relate generally to air-conditioning ducts, and more particularly, to systems and methods of filtering air through air-conditioning ducts accessible from below the ceiling rather than from the roof or through the ceiling.

Air conditioning systems operate at the optimum efficiency when the air circulating through the system has no dust or debris. Conventionally, air conditioning systems use air filtration systems to eliminate dust and debris from the circulating air. While the air filtration is effective at removing dust and debris from the air, the filter used in the system must be replaced frequently for the air filtration system to remain effective at collecting debris. Infrequent replacement of the filter adversely affects the efficiency of the air conditioning system because either the air would not be filtered effectively, or the formation of excess debris on the filters (clogged filters) would reduce air flow through the air conditioning system, effectively reducing the capacity of the air conditioning system and effectively requiring the system to work beyond its capacity to circulate the design air flow through the polluted filter. Moreover, it is determined that existence of debris in the circulating air can reduce the efficiency of the air conditioning system up to 20 percent or more, and hence increasing power consumption and decreasing performance.

Although advances in filtration technology have led to better collection of debris, in order to maintain the performance of the air conditioning systems at the optimum level, the filters must be replaced on a routine basis or predetermined periods. Because the filters are being used to filter both of outside air and returning air of an air-conditioned dwelling, commercial space, or institutional space, these filters tend to get covered by debris (build up) very often, and hence undermine the performance of the air conditioning unit or system. However, it is often difficult to replace the air filters for the majority of the air conditioning units or systems. The majority of air conditioning units or systems include rooftop units and fan coil units, split packaged indoor sections, and water source heat pumps. These units are not simply accessible because they are either placed over the roof, or between the roof and the ceiling. The poor placement of these units or systems requires users to climb a ladder over the roof, or enter up to the waist through the ceiling to replace the air-conditioning system's filter.

Therefore, it would be desirable to provide a system and method that overcomes the above problems. The system and method would provide an easily accessible filtration system. The easily accessible filtration system would permit a user to change the filter of the air conditioning unit without having to go over the roof, or through the ceiling.

SUMMARY

An air conditioning system duct housing typically includes among other things, a plurality of walls coupled together having at least one outside air intake and at least one return air intake, an air supply outlet channel and a filter. The filter is interposed between at least one outside air intake, at least one return air intake and the air supply outlet channel.

An air conditioning system duct housing comprising, a plurality of walls coupled together having at least one outside air intake, at least one return air intake, an air supply outlet channel and a filter. The filter is interposed between at least one outside air intake, at least one return air intake and the air supply outlet channel. A grill is also coupled to a lower wall of the air conditioning ductwork system.

An air conditioning system duct housing comprising, a plurality of walls coupled together having at least one outside air intake, at least one return air intake, an air supply outlet channel and a filter. The filter is interposed between at least one return air intake, at least one outside air intake, and the supply outlet air channel. A grill also is coupled to a lower wall of the air conditioning ductwork system. The lower wall is positioned adjacent to a ceiling.

BRIEF DESCRIPTION OF THE DRAWINGS

Embodiments of the disclosure will become more fully understood from the detailed description and the accompanying drawings, wherein.

DETAILED DESCRIPTION

Figure 1A:
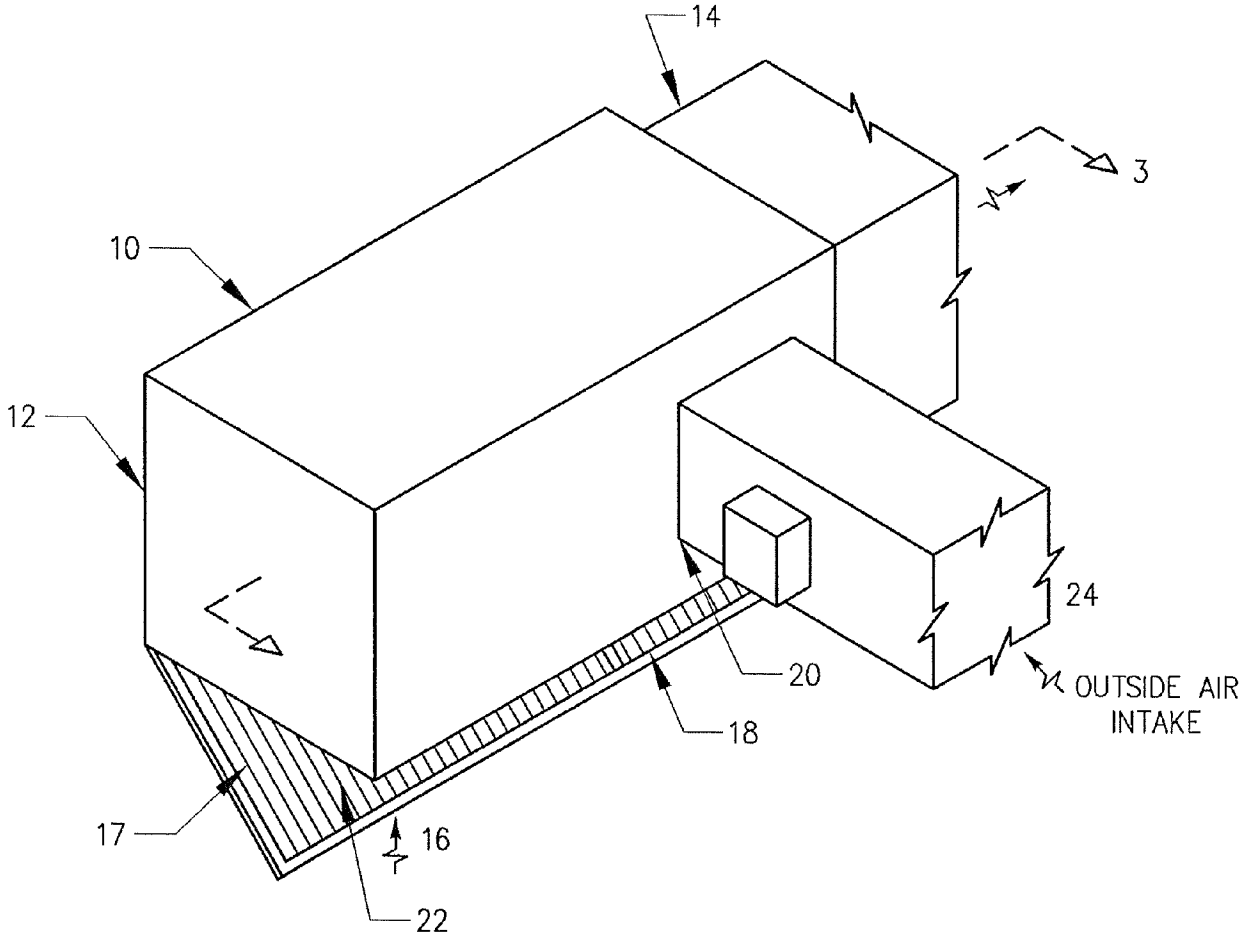
FIG. 1A is a perspective view of the air conditioning system duct housing.

Referring to FIG. 1A, a perspective view of the air conditioning system duct housing 10 ("duct housing") is shown. The duct housing 10 is shown as having a plurality of walls 12. In this embodiment, the walls 12 may form different geometric shapes. In the present embodiment, the walls 12 form a rectangular shaped duct housing 10. However, this is shown as one embodiment and should not be seen in a limiting scope. The duct housing 10 may form other geometric shapes without departing from the spirit and scope of the present invention.

The duct housing 10 may include at least one outside air intake 20 and at least one return air intake 22. The outside air intake 20 and the return air intake 22 may be used to receive air into the duct housing 10. The duct housing 10 may further include an air supply outlet channel 14. The air supply outlet channel 14 may be used to return the air conditioning system (air conditioning unit, heat pump indoor section, fan coil unit, water source heat pump or similar unit). In this embodiment, the outside air intake 20 may extend from the duct housing 10. The return air intake 22 will be discussed in detail below with reference to FIG. 2.

Figure 1B:
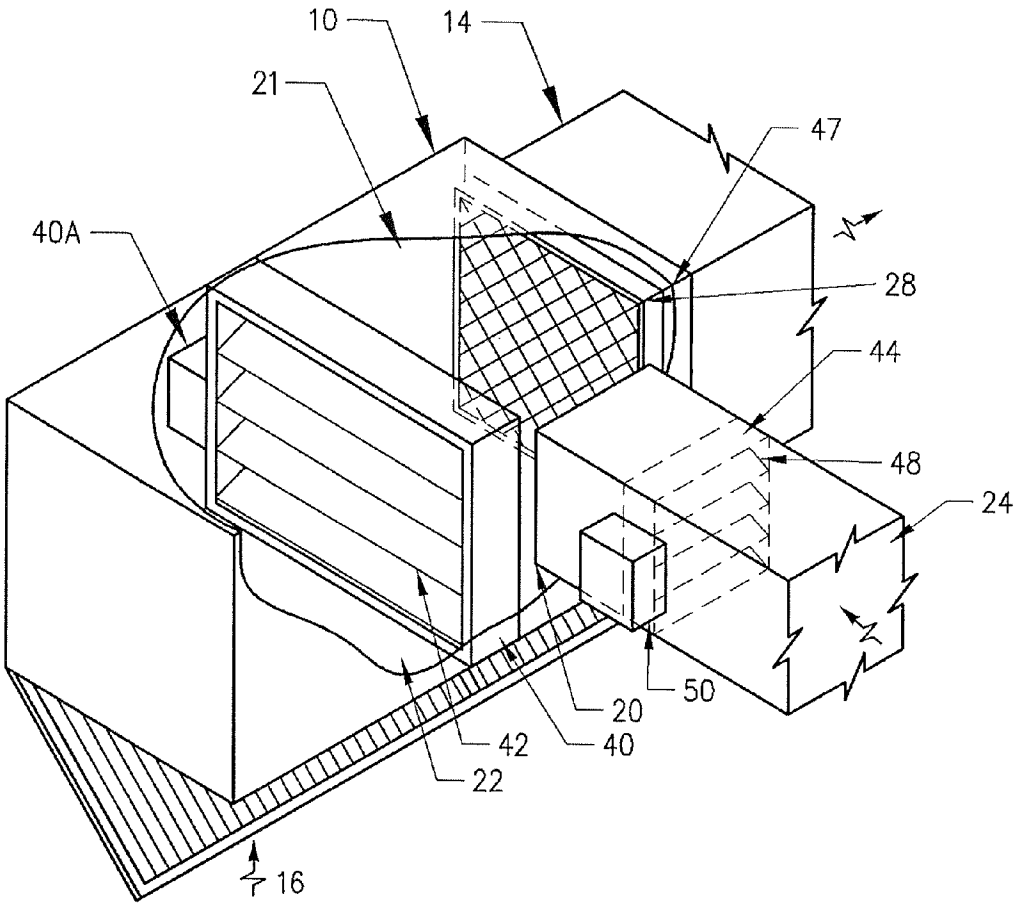
FIG. 1B is a cut-away view of the FIG. 1*a*, showing the inside of the air conditioning system duct housing.

Referring now to FIG. 1B, the duct housing 10 may receive both return air 16 from a dwelling, commercial building, or institution and outside air 24 into the duct housing 10. The duct housing 10 in combination with an air conditioning unit or system air conditioning unit, heat pump indoor section, fan coil unit water source heat pump or similar unit (not shown) lowers the air pressure within the duct housing 10, and hence air outside of the duct housing 10 with higher pressure flows into the duct housing 10. In this embodiment, the return air intake and the outside air intake 20 receive air into the duct housing 10 when the air pressure within the duct housing 10 is lower than the air pressure outside of the duct housing 10. Thereafter, the outside air 24 and the return air 16 merge in the duct housing 10 before entering to the air supply outlet channel 14.

Moreover, FIG. 1B illustrates a sub-housing 21 (mixed air plenum) within the duct housing 10, wherein the outside air 24 and the return air 16 mix. The sub-housing 21 is an area within the air conditioning duct housing 10. Here, the sub-housing 21 may be interposed between the outside air intake 20, the return air intake 22 and the air supply outlet channel 14. A cover plate 95 over the grill 18, gasketed to 96 to the bottom of the sub-housing 17 forms a true outside air, return air mixing plenum. Subsequently, air merged (mixed) in the sub-housing 21 may be received by a filter 28 and passed to the air supply outlet channel 14. The filter 28 may be a detachable filter so it can be replaced when needed. The filter 28 may be an electronic filter, mechanical filter, fabric filter, or the like. The listing is given as an example and should not be seen in a limiting manner. As it will be discussed in FIG. 2, the filter 28 may be accessible from a lower wall 26 of the duct housing 10.

Figure 2:
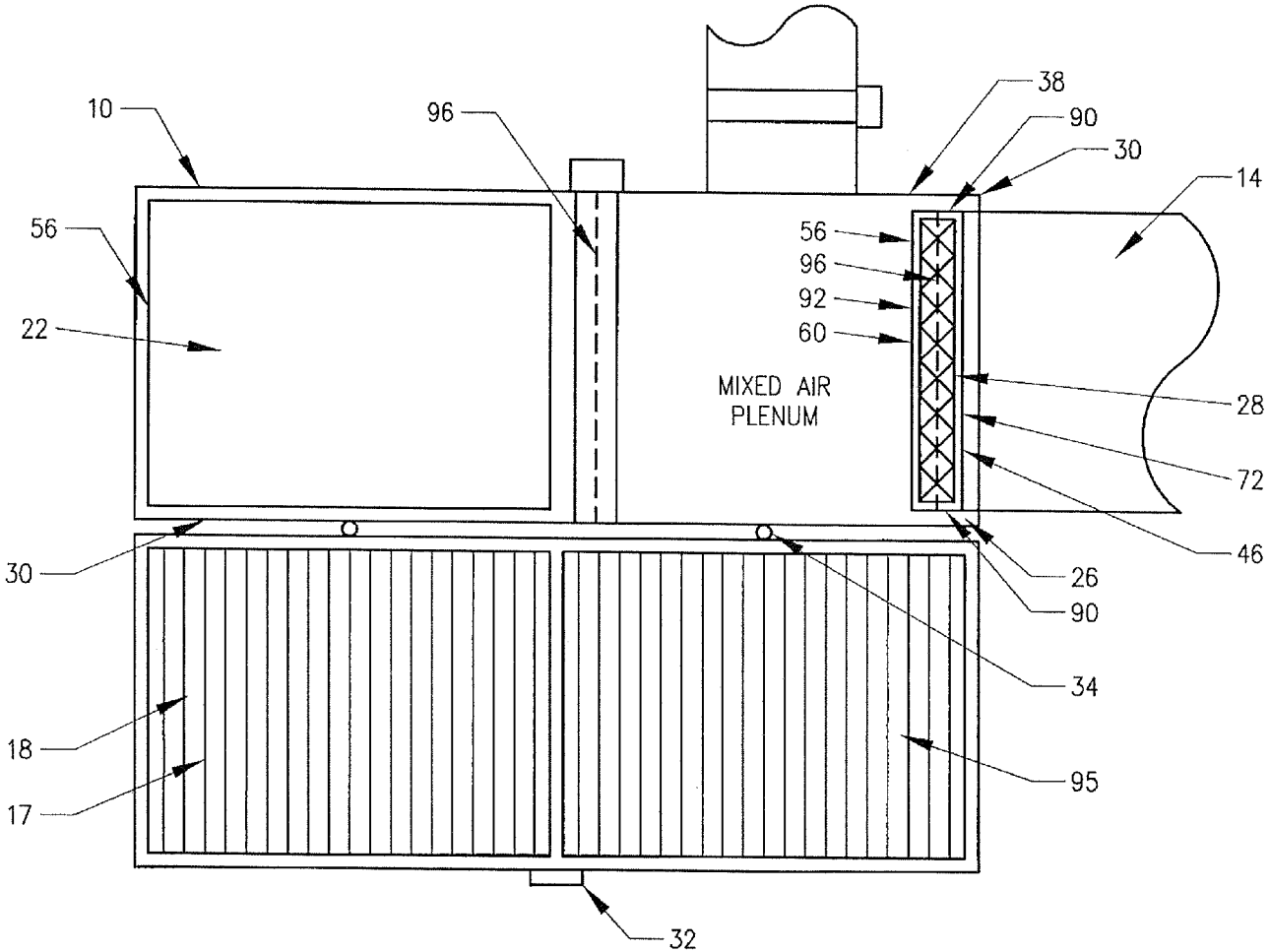
FIG. 2 is a bottom view of the air conditioning duct system duct housing with a grill at an open position.

Referring now to FIG. 2, a view of the lower wall 26 of the duct housing 10 is illustrated. In this embodiment, the lower wall 26 may be comprised of the return air intake 22, and a receiving aperture 46 adjacent to the air supply channel 14. The receiving aperture 46 may receive the filter 28 therein. In this embodiment, the location of the receiving aperture 46 on the lower wall 26 may allow the filter 28 to separate the sub-housing 21 from the supply outlet channel 14. In this embodiment, the position of the receiving aperture 46 may allow the filter 28 to be positioned at the perimeter 47 (FIG. 1*b*) of the air supply outlet channel 14. The receiving aperture (filter rack) 46 may further secure the filter 28 within the duct housing 10. In this embodiment, the receiving aperture 46 may comprise at least one fastener 56 to securely hold the filter 28 therein.

The filter 28 may be any type of air conditioner filter. In some embodiments of the filter 28, the filter 28 (shown in FIG. 3) may be comprised of a lower side 58 having a lower face 56 and an upward face 72. The lower side 58 of the filter 28 may be interposed between the perimeter 60 of the receiving aperture (filter rack) 46 and a grill 18. The grill 18 will be discussed in details in regards to FIGS. 2 and 3.

Referring now to FIG. 2, the receiving aperture 46 may also include railings 90. The railings 90 may be formed at the perimeter 60 of the receiving aperture 46. The railings 90 may help to direct the filter 28 to a predetermined position within the duct housing 10. The railings (filter frame) 90 make sure the filter 28 stands perpendicular to the lower wall of the duct housing 10. In this embodiment, the railings (filter frame 90 further assists in keeping the filter 28 in a predetermined location with respect to the air supply outlet channel 14. In particular, embodiments of the receiving aperture 46, the perimeter 60 of the receiving aperture 46 may also include a filter frame clip 92 to interface with the outer frame of a filter 28.

Furthermore, the lower wall 26, as shown in FIG. 2, may be pivotally coupled to a plurality of spaced-apart fins 17. In this embodiment, the plurality of spaced-apart fins 17 forms the grill 18. The grille 18 is sealed with a metal plate 95 on the sub-housing 21 side. This results in all air entering the plenum from either the return air 22 or outside air 20 intakes. Although, the grill 18 may be coupled to the lower wall 26 using variety of means, in the present embodiment, the grill 18 is hingeably connected to a perimeter 30 of the lower wall 26 using at least one hinge 34. Furthermore, as the grill 18 may be coupled to the lower wall 26 at one side, it may fasten to an opposing side 38 of the lower wall 26 using a fastener 32. In other embodiments, a pivotal connection between the lower wall 26 and the grill 18 may take place using at least one of case hinge, pivot hinge, or barrel hinge while the fastening may take place using clips, screws, or lock and loop fasteners. The grille 18 has a solid plate on the (mixed air plenum) sub-housing 21 bottom.

Figure 3:
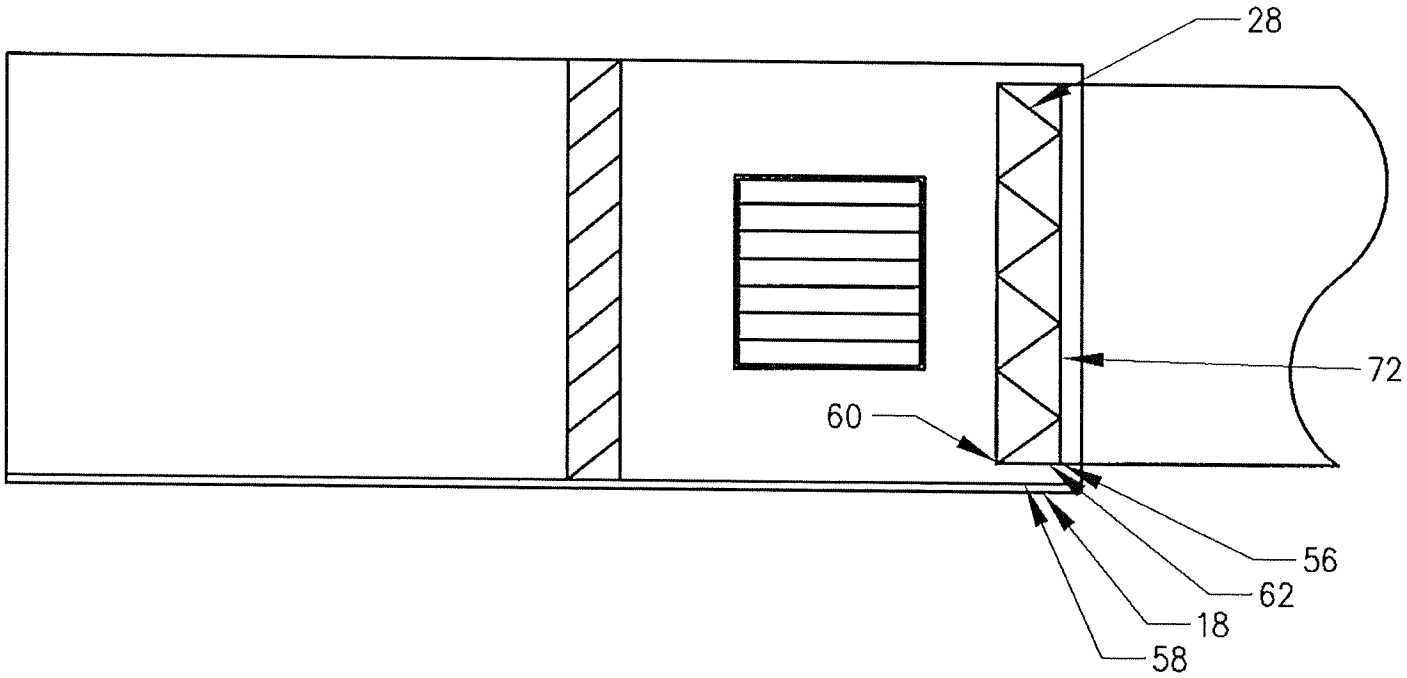
FIG. 3 is a cross-sectional view of the air conditioning system duct housing along line 3-3 of FIG. 1*a*.

Referring now to FIG. 3, the grill 18 is shown when interfacing with the lower wall 26. Here, the grill 18 pushes against the lower face 59 of the lower side 58 of the filter 28. Subsequently, the upward face 72 of the lower side 58 of the filter 28 may be pressed against the perimeter 60 of the receiving aperture 46. In this particular embodiment of the duct housing 10, the arrangement helps to station the filter 28 in a predetermined place in relation to the air supply channel 14.

Figure 4:
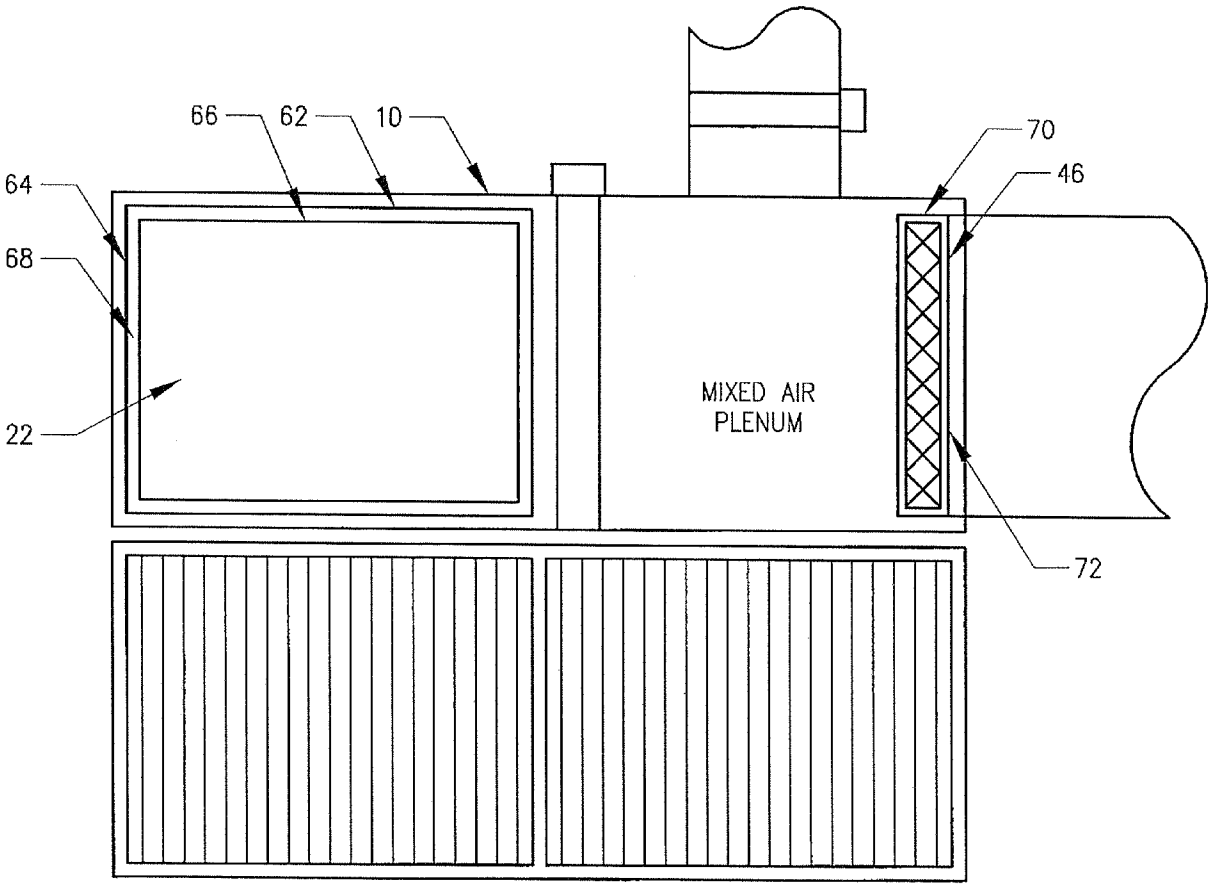
FIG. 4 is a bottom view of an embodiment of particular implementations of the air conditioning system duct housing.

Other embodiments of the duct housing 10 are also possible. FIG. 4 illustrates a particular embodiment of the duct housing 10, wherein the return air intake 22 may further comprise a perimeter 62 having a first edge 64 and a second edge distal from the first edge 64. The distance between the first edge 64 and the second edge 66 provides for a ledge 68 extended around the perimeter of the one return air intake 22.

Furthermore, in this embodiment, the receiving aperture 46 (filter rack) may also comprise a ledge 70 around its perimeter 60. The ledge 70 may allow an upper face 72 of the lower side 58 of the filter 28 to rest thereupon. Having the ledge 70 is advantageous because it prevents the filter 28 from entering the duct housing 10. The upper face 72 of the lower side 58 of the filter 28 may rest on the ledge 70, while the rest of the filter 28 enters the receiving aperture 46. In this embodiment, the type of filter is of no significance. However, in some embodiment of the filter 28, the lower side 58 of the filter 28 may include an outer frame member. The outer frame member may be made of metal or plastic, which may be used to maintain the filter 28 between the ledge 72 and the grill 18 when the grill 18 interfaces with the lower wall 26.

Referring back now to FIG. 1*a*, the lower wall 26 may be extendable through a ceiling. This may allow the grill 18 to be placed either below a ceiling, or in the same plane as the ceiling. This arrangement may permit a user to release the grill 18 from the duct housing 10 and replace the filter 28 from below the ceiling. As shown in FIG. 2, the filter 18 may be accessible from below the duct housing 10. Thus, the user is no longer required to climb a ladder over the roof, or enter into the ceiling to replace the filter 28 of the duct housing 10.

While it is important to maintain the air conditioning housing accessible to the user, a system that requires less frequent change of the filter 28 is also advantageous. Therefore, the duct housing 10 may include a shutoff (damper) mechanism to manage outside air that provides a source of dirt which rapidly wears the filter 28 out. As shown in FIG. 1B, the shutoff mechanism may be achieved using dampers 40, 44. Here, the duct housing 10 is shown having a first damper 40 adjacent to the return air intake 22, and a second air damper 44 in the outside air intake duct 20. The first damper 40 may comprise a set of damper blades mounted on shafts inside a damper frame 42 for opening and closing the first damper 40. Here, the first damper 40 may be interposed between the return air intake 22 and the filter 28. In this embodiment, the first damper plenum 40 reduces or stops the flow of air from the return air 16 into the duct housing 10 by closing the damper blades 42. The damper blades 42 may be controllable using a first controller actuator 40A coupled to the duct housing 10 and damper blades. While the type of first controller actuator 40A is not of significance, the first controller actuator 40A may be a mechanical handle or an electric powered actuator. The above are given as examples and should not be seen in a limiting manner.

Moreover, as illustrated in FIG. 1A, the second damper 44 may be placed in to the outside air intake duct 20 to control the flow of air from the outside air intake duct 20 into the duct housing 10 mixed air plenum sub-housing 21. Building codes require outside air for occupied space ventilation.

The second damper plenum 44 also uses a set of damper blades 48. Similar to the first damper plenum 40, movements of the damper blades 48 of the second damper plenum 44 may be controllable by a second controller 50. The controller 50 may be coupled to the outside air intake duct while connecting to the second damper plenum 44.

Because the air pollution (particulate) wears the filter out (packs with dirt) very quickly, having the ability to manage or control the flow of air into the housing is desirable. A major source of dirt is the outside air. Managing or controlling the amount of outside air to code required rates saves significant energy while reducing a major source of dirt and therefore extending filter life. Thus, the controllers also may be controlled manually or automatically. In some embodiments of the duct housing, the damper plenums may use sensors (carbon dioxide) to measure the air pollution (carbon dioxide) at the occupied space (return air) inlet. If the pollution level measured by the (carbon dioxide) sensors is below a predetermined threshold (800 parts per million above ambient carbon dioxide levels), those sensors may signal the controller to shutoff the outside air damper (damper actuators 50) plenum, and hence stop the outside air flow from a particular intake.

While embodiments of the disclosure have been described in terms of various specific embodiments, those skilled in the art will recognize that the embodiments of the disclosure may be practiced with modifications within the spirit and scope of the claims.

What is claimed is:

1. An air conditioning system duct housing comprising:

a plurality of walls coupled together, having at least one outside air intake, at least one return air intake and an air supply outlet channel;

a sub-housing within the duct housing interposed between the outside air intake on a first surface of the sub-housing, the return air intake on a second surface of the sub-housing and the air supply outlet channel on a third surface of the sub-housing, wherein air mixes from the outside air intake and the return air intake;

a filter adjacent to the air supply outlet channel; and a receiving aperture formed on the second surface of the sub-housing to receive the filter therein, wherein the receiving aperture is interposed between the at least one outside air intake, the at least one return air intake and the air supply outlet channel.

2. The air conditioning system duct housing of claim 1, further comprising:

a first damper plenum coupled to the at least one return air intake; and a second damper plenum coupled to the at least one outside air intake.

3. The air conditioning system duct housing of claim 2, further comprising: a first controller actuator and a second controller actuator coupled to the first damper plenum and the second damper plenum respectively.

4. The air conditioning system duct housing of claim 1, wherein the filter is one of electronic filter, mechanical filter or fabric filter.

5. The air conditioning system duct housing of claim 1, further comprising a grill extended over a majority of the at least one return air intake and covering the filter.

6. The air conditioning system duct housing of claim 5, wherein the at least one return air intake further comprising a second filter positioned between the at least one return air intake and the grill.

7. The air conditioning system duct housing of claim 1, wherein a lower wall of the plurality of walls is positioned adjacent to a ceiling.

8. An air conditioning system duct housing comprising:

a plurality of walls coupled together, having at least one outside air intake, at least one return air intake and an air supply outlet channel;

a sub-housing within the duct housing interposed between the outside air intake on a first surface of the sub-housing, the return air intake on a second surface of the sub-housing and the air supply outlet channel on a third surface of the sub-housing, wherein air mixes from the outside air intake and the return air intake;

a filter adjacent to the air supply outlet channel;

a receiving aperture formed on the second surface of the sub-housing to receive the filter therein, wherein the receiving aperture is interposed between the at least one outside air intake, the at least one return air intake and the air supply outlet channel;

a first damper plenum coupled to the at least one return air intake;

a second damper plenum coupled to the at least one outside air intake; and a grill coupled to the air conditioning system duct housing.

9. The air conditioning system duct housing of claim 8, comprising the first damper plenum and the second damper plenum having a first electric powered actuator and a second power actuator respectively.

10. The air conditioning system duct housing of claim 8, wherein the filter is one of electronic filter, mechanical filter or fabric filter.

11. The air conditioning system duct housing of claim 8, further comprising the grill hingeably coupled to the lower wall of the air conditioning system duct housing, and extended over at least a portion of the filter.

12. The air conditioning system duct housing of claim 11, wherein the at least one return air intake further comprising a second filter positioned between the at least one return air intake and the grill.

13. An air conditioning system duct housing comprising:

a plurality of walls coupled together, having at least one outside air intake and at least one return air intake and an air supply outlet channel;

a filter;

a receiving aperture to receive the filter therein, wherein the receiving aperture is interposed between the at least one outside air intake, the at least one return air intake and the air supply channel;

a grill coupled to the air conditioning system duct housing; and wherein the grill is positioned adjacent to a ceiling.

14. The air conditioning system duct housing of claim 13, wherein the at least one grill hingebly coupled to the lower wall at one end and securely coupled to an opposing end of the lower wall using a fastener.

15. The air conditioning system duct housing of claim 13, wherein the filter is one of electronic filter, mechanical filter, or fabric filter.

16. The air conditioning system duct housing of claim 13, wherein at least one return air intake and at least one outside air intake couple to a first damper plenum and a second damper plenum respectively, and the first damper plenum and the second damper plenum coupled with a first controller and a second controller respectively.

17. The air conditioning system duct housing of claim 13, further comprising at least one grill extended over the majority of at least one return air intake.

18. The air conditioning system duct housing of claim 17, wherein at least one return air intake comprising a second filter interposed between at least one return air intake and the grill.

19. The air conditioning system duct housing of claim 13, wherein the grill exerts pressure against the filter to maintain the filter in a predetermined position. Clips hold the filter into a slide rack.

* * * * *